US010288332B2

(12) United States Patent
Nagafuji

(10) Patent No.: US 10,288,332 B2
(45) Date of Patent: May 14, 2019

(54) CONDENSER

(71) Applicant: KEIHIN THERMAL TECHNOLOGY CORPORATION, Oyama-shi (JP)

(72) Inventor: Teruyuki Nagafuji, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 0 days.

(21) Appl. No.: 15/686,165

(22) Filed: Aug. 25, 2017

(65) Prior Publication Data

US 2018/0058737 A1 Mar. 1, 2018

(30) Foreign Application Priority Data

Aug. 30, 2016 (JP) ..... 2016-167758
Jun. 6, 2017 (JP) ..... 2017-111374

(51) Int. Cl.
*F25B 39/00* (2006.01)
*F25B 39/04* (2006.01)
*F25B 40/02* (2006.01)

(52) U.S. Cl.
CPC ..... *F25B 39/04* (2013.01); *F25B 40/02* (2013.01); *F25B 2339/0441* (2013.01); *F25B 2339/0442* (2013.01); *F25B 2400/162* (2013.01)

(58) Field of Classification Search
CPC ..... F25B 39/04; F25B 2339/044; F25B 2339/0441; F25B 2339/0442
See application file for complete search history.

(56) References Cited

U.S. PATENT DOCUMENTS 8,387,407 B2 * 3/2013 Kaspar ..... F25B 39/04 62/317
2008/0115528 A1 * 5/2008 Yamamoto ..... B60H 1/3227 62/513
2009/0288443 A1 11/2009 Lautner et al.

FOREIGN PATENT DOCUMENTS

JP 2004077053 * 3/2004
JP 4743802 B2 8/2008

* cited by examiner

*Primary Examiner* — Eric S Ruppert
(74) *Attorney, Agent, or Firm* — Mori & Ward, LLP

(57) ABSTRACT

A condenser includes a condensation section, a super-cooling section located above the condensation section, and a liquid receiver. The liquid receiver has a first space communicating with the condensation section through a refrigerant inlet and a second space located above the first space and communicating with the super-cooling section through a refrigerant outlet. A partition member is provided in the liquid receiver in order to divide the internal space of the liquid receive into the first space and the second space. A suction pipe which is open at upper and lower ends thereof and which establishes communication between the first space and the second space is disposed in the first space of the liquid receiver. The partition member has an internal volume adjustment portion for increasing the internal volume of the first space and decreasing the internal volume of the second space.

10 Claims, 6 Drawing Sheets

CONDENSER

BACKGROUND OF THE INVENTION

The present invention relates to a condenser used in a refrigeration cycle which constitutes, for example, a car air conditioner.

Herein and in the appended claims, the upper side, lower side, left-hand side, and right-hand side of FIGS. 1 and 2 will be referred to as "upper," "lower," "left," and "right," respectively.

There has been known a condenser of a refrigeration cycle which constitutes a car air conditioner (see Japanese Patent No. 4743802). The known condenser includes a condensation section, a super-cooling section provided above the condensation section, and a liquid receiver provided between the condensation section and the super-cooling section. Each of the condensation section and the super-cooling section has at least one heat exchange path formed by a plurality of heat exchange tubes disposed parallel to one another such that their longitudinal direction coincides with the left-right direction and they are spaced from one another in the vertical direction. Refrigerant flowing out of the condensation section flows into the super-cooling section through the liquid receiver. The liquid receiver has a refrigerant inlet through which the refrigerant from the condensation section flows into the liquid receiver, and a refrigerant outlet which is located above the refrigerant inlet and through which the refrigerant flows out to the super-cooling section. A partition member (horizontal plate) is disposed in the liquid receiver at a vertical position between the condensation section and the super-cooling section so as to divide the interior of the liquid receiver into a first space communicating with the condensation section through the refrigerant inlet, and a second space located above the first space and communicating with the super-cooling section through the refrigerant outlet. A suction pipe which is open at upper and lower ends thereof and establishes communication between the first space and the second space is disposed in the first space of the liquid receiver. The interior of the suction pipe communicates with the second space through a communication opening in the form of a through hole provided in the partition member. An operation member is provided on the upper surface of the partition member.

In the condenser described in the above-described publication, the refrigerant having passed through the condensation section flows into the first space within the liquid receive though the refrigerant inlet, flows into the second space through the suction pipe, and then flows into the super-cooling section through the refrigerant outlet.

However, the condenser described in the above-described publication has the following problem. When a refrigeration cycle including the above-described condenser is charged with refrigerant, a relatively long time is needed until the refrigerant charge amount reaches a proper charge amount for realizing a predetermined degree of super-cooling. Also, the width of a stable range within which the predetermined degree of super-cooling is realized is relatively narrow.

SUMMARY OF THE INVENTION

An object of the present invention is to solve the above-described problem and provide a condenser which allows quick charging of a refrigeration cycle including the condenser with a proper amount of refrigerant and which can increase the width of a stable range within which a predetermined degree of super-cooling is realized.

A condenser according to the present invention comprises a condensation section, a super-cooling section provided above the condensation section, and a liquid receiver provided between the condensation section and the super-cooling section, wherein refrigerant flowing out of the condensation section flows into the super-cooling section through the liquid receiver. Each of the condensation section and the super-cooling section has at least one heat exchange path formed by a plurality of heat exchange tubes disposed parallel to one another such that their longitudinal direction coincides with a left-right direction and they are spaced from one another in a vertical direction. The liquid receiver has a refrigerant inlet through which the refrigerant from the condensation section flows into the liquid receiver, and a refrigerant outlet which is located above the refrigerant inlet and through which the refrigerant flows out to the super-cooling section. A partition portion is provided in the liquid receiver so as to divide a space within the liquid receiver into a first space communicating with the condensation section through the refrigerant inlet, and a second space located above the first space and communicating with the super-cooling section through the refrigerant outlet. A suction pipe which is open at upper and lower ends thereof and establishes communication between the first space and the second space is disposed in the first space of the liquid receiver. A space within the suction pipe communicates with the second space through a communication opening provided in the partition portion. The partition portion has an internal volume adjustment portion for increasing an internal volume of the first space and decreasing an internal volume of the second space.

DESCRIPTION OF THE PREFERRED EMBODIMENT

An embodiment of the present invention will next be described with reference to the drawings.

Figure 1:
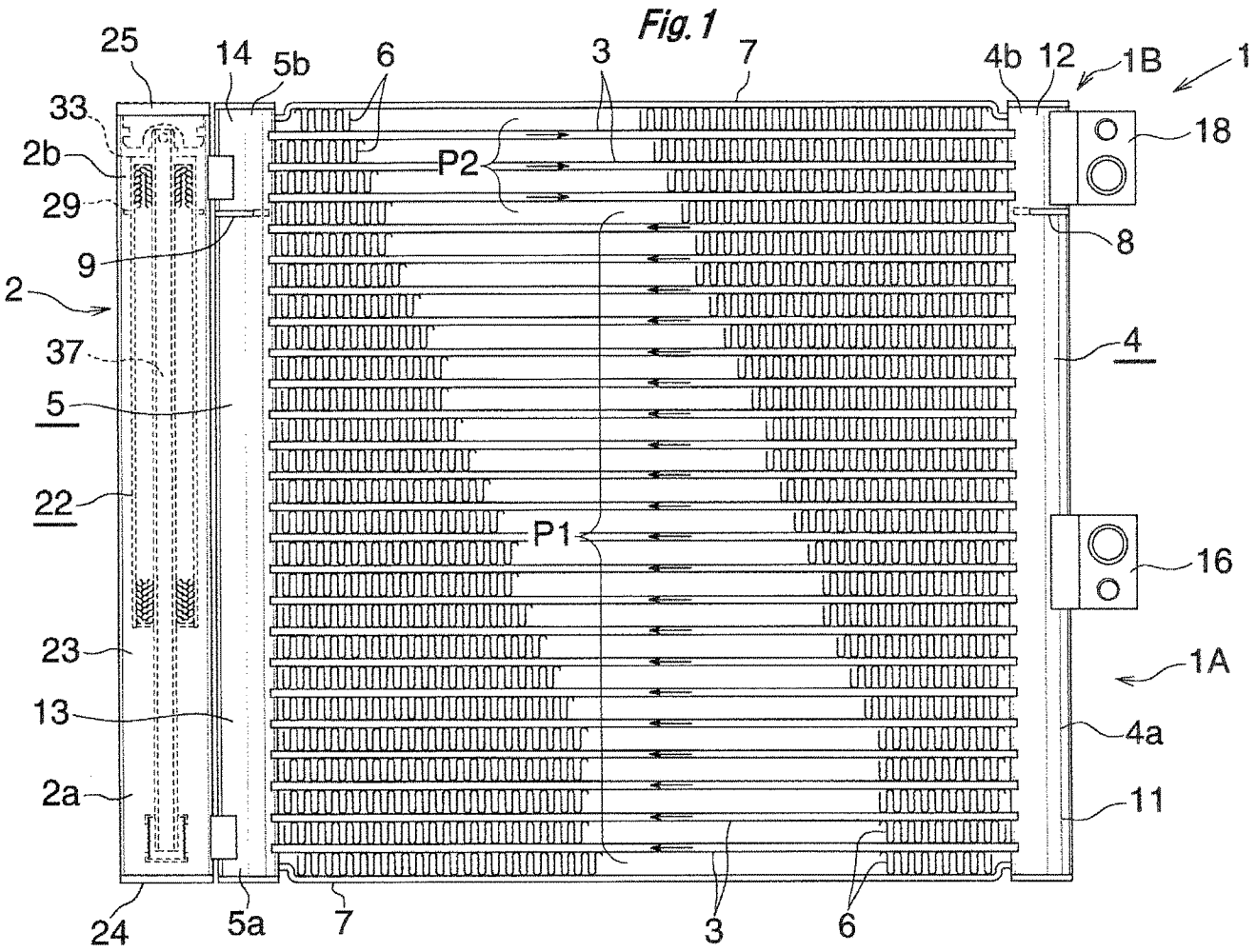
FIG. 1 is a front view showing the overall structure of a condenser according to the present invention.

In the following description, a direction perpendicular to the sheet on which FIG. 1 is drawn will be referred to as an "air-passing direction."

The term "aluminum" as used in the following description encompasses aluminum alloys in addition to pure aluminum.

Figure 2:
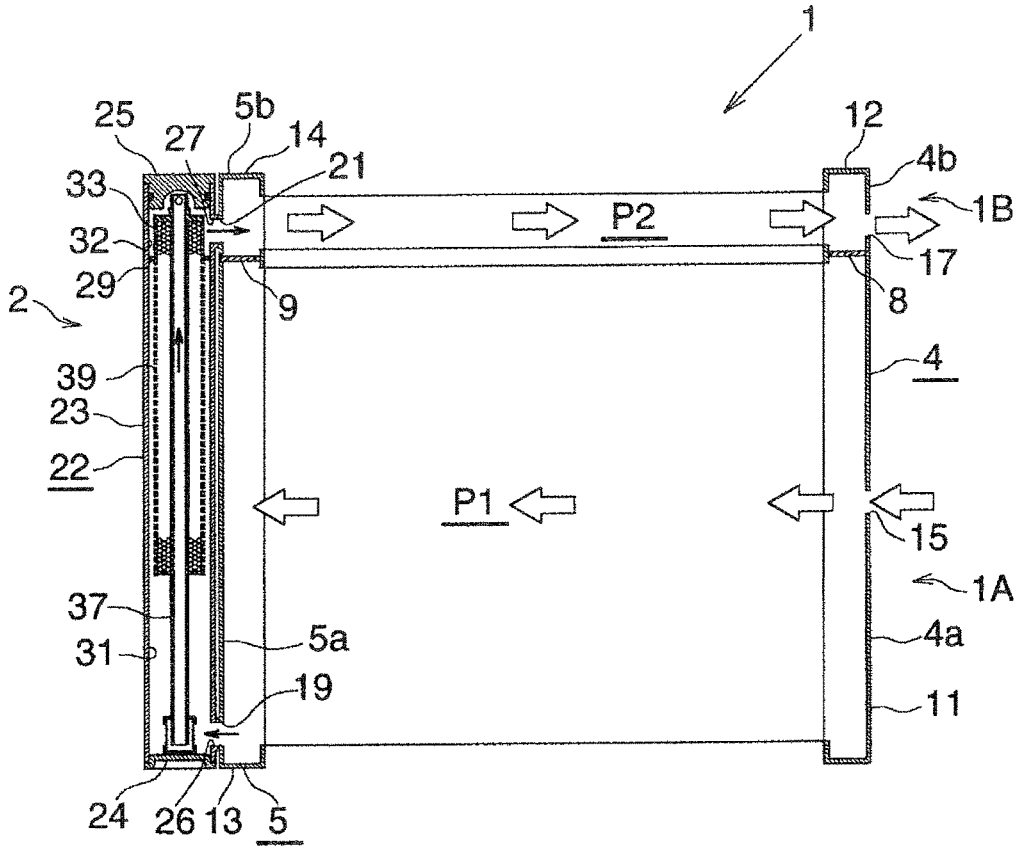
FIG. 2 is a front view schematically showing the condenser of FIG. 1.
Figure 3:
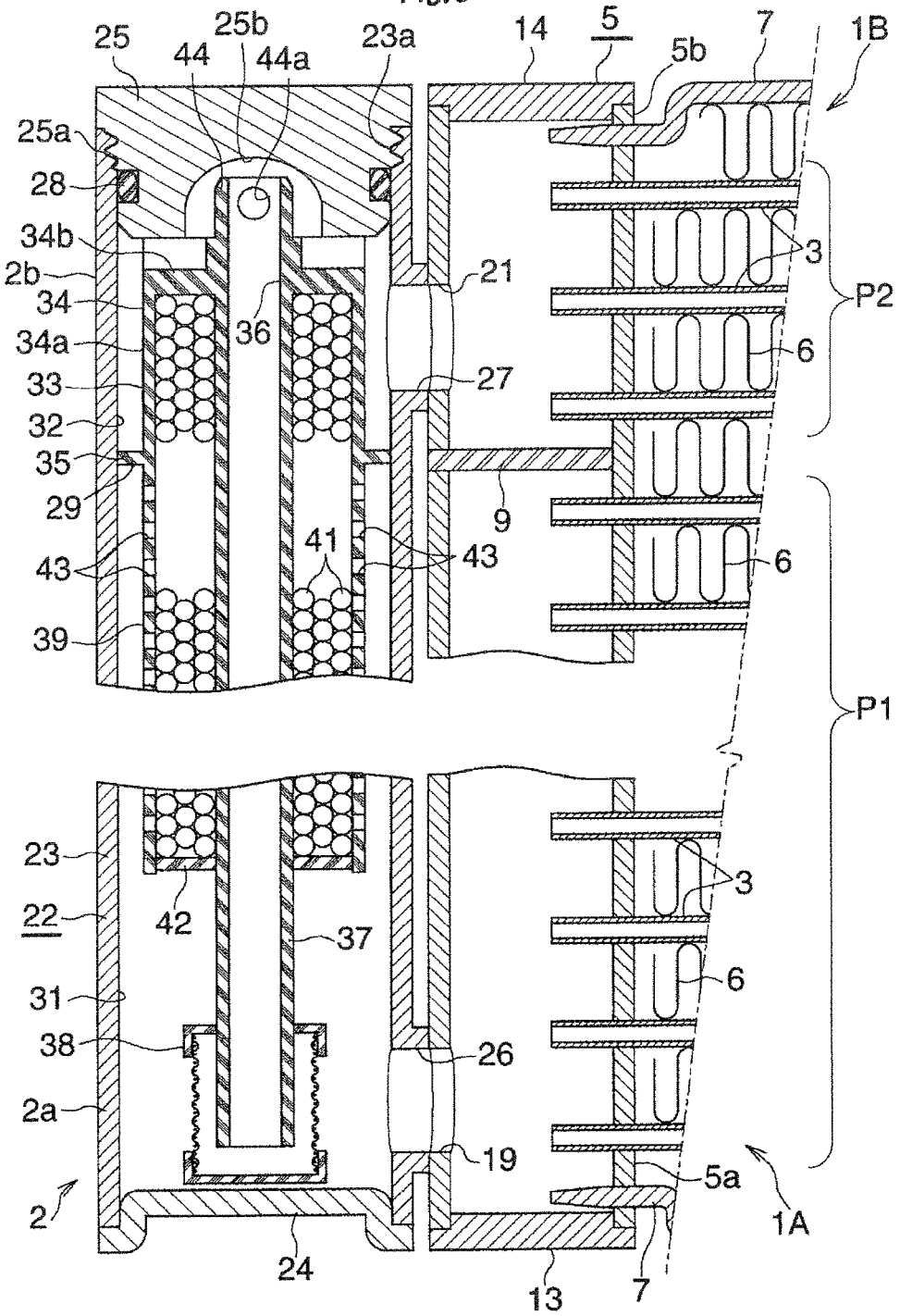
FIG. 3 is a vertical sectional view showing, on an enlarged scale, the internal structure of a liquid receiver of the condenser of FIG. 1, with an intermediate portion of the condenser omitted.
Figure 4:
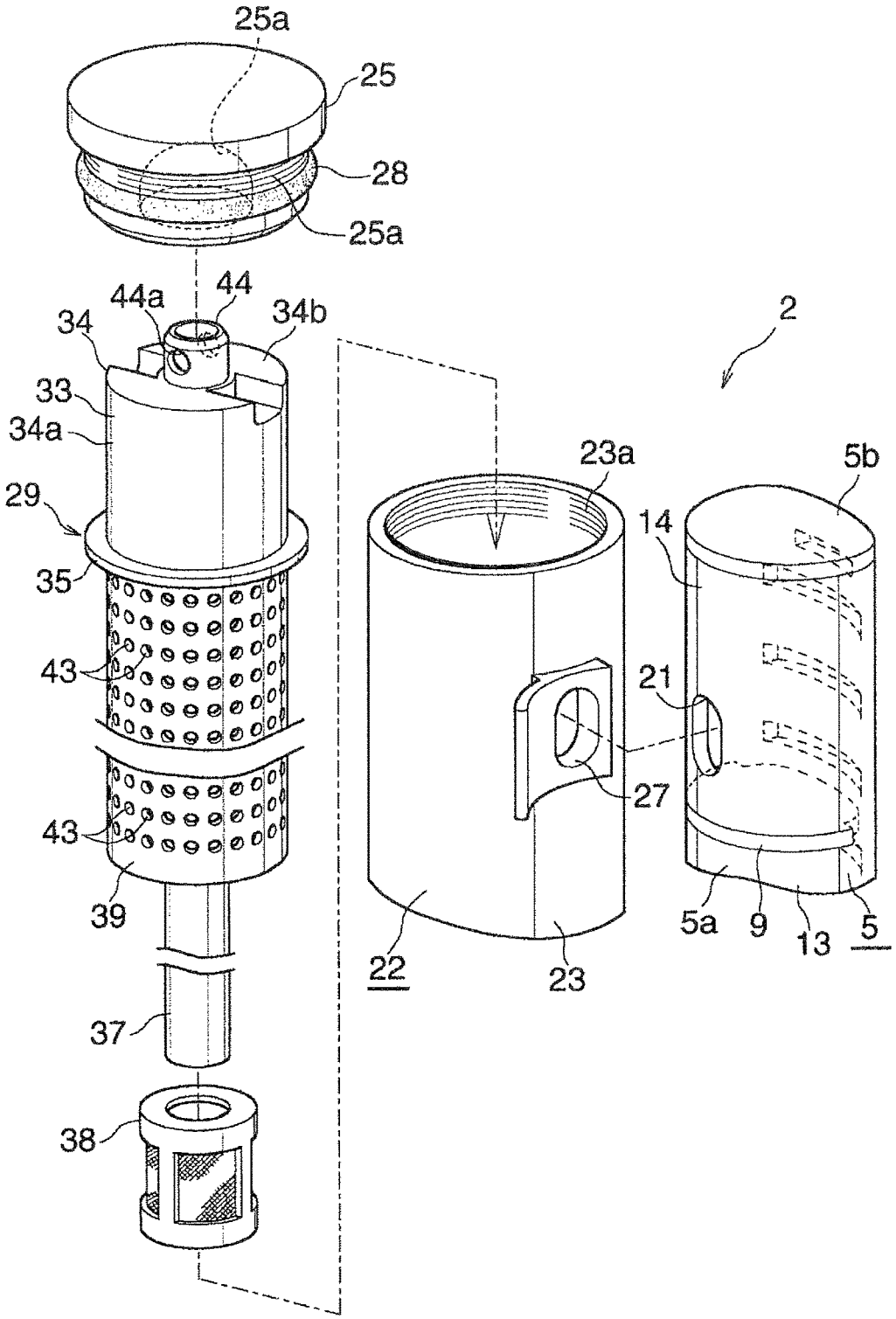
FIG. 4 is an exploded perspective view showing, on an enlarged scale, the internal structure of the liquid receiver of the condenser of FIG. 1.

FIG. 1 specifically shows the overall structure of a condenser according to the present invention. FIG. 2 schematically shows the condenser of FIG. 1 in which illustration of some members is omitted. FIGS. 3 and 4 show the structure of a main portion of the condenser of FIG. 1.

As shown in FIGS. 1 and 2, a condenser 1 includes a condensation section 1A; a super-cooling section 1B provided above the condensation section 1A; and a tank-like liquid receiver 2 provided between the condensation section 1A and the super-cooling section 1B such that the longitudinal direction of the liquid receiver 2 coincides with the vertical direction. The liquid receiver 2 has a gas-liquid separation function.

The condenser 1 includes a plurality of flat heat exchange tubes 3 formed of aluminum, two header tanks 4 and 5 formed of aluminum, corrugate fins 6 formed of aluminum, and side plates 7 formed of aluminum. The heat exchange tubes 3 are disposed such that their width direction coincides with the air-passing direction, their longitudinal direction coincides with the left-right direction, and they are spaced from one another in the vertical direction. The header tanks 4 and 5 are disposed such that their longitudinal direction coincides with the vertical direction and they are spaced from each other in the left-right direction, and opposite longitudinal end portions of the heat exchange tubes 3 are joined to the header tanks 4 and 5 through use of a brazing material. Each of the corrugate fins 6 is disposed between and joined to adjacent heat exchange tubes 3 through use of a brazing material, or is disposed on the outer side of the uppermost or lowermost heat exchange tube 3 and joined to the corresponding heat exchange tube 3 through use of a brazing material. The side plates 7 are disposed on the corresponding outer sides of the uppermost and lowermost corrugate fins 6, and are joined to these corrugate fins 6 through use of a brazing material. In the following description, joining through use of a brazing material will also be referred to as "brazing."

The condensation section 1A of the condenser 1 includes at least one heat exchange path (in the present embodiment, one heat exchange path P1) formed by a plurality of heat exchange tubes 3 successively arranged in the vertical direction. The super-cooling section 1B of the condenser 1 includes at least one heat exchange path (in the present embodiment, one heat exchange path P2) formed by a plurality of heat exchange tubes 3 successively arranged in the vertical direction. The flow direction of refrigerant is the same among all the heat exchange tubes 3 which form each heat exchange path P1, P2. The flow direction of refrigerant in the heat exchange tubes 3 which form a certain heat exchange path is opposite the flow direction of refrigerant in the heat exchange tubes 3 which form another heat exchange path adjacent to the certain heat exchange path. The heat exchange path P1 of the condensation section 1A will be referred to as the first heat exchange path, and the heat exchange path P2 of the super-cooling section 1B will be referred to as the second heat exchange path.

The header tank 4 has a partition member 8 which is formed of aluminum and is provided at a vertical position between the first heat exchange path P1 and the second heat exchange path P2 so as to divide the space within the header tank 4 into two compartments 4*a* and 4*b* arranged in the vertical direction. Similarly, the header tank 5 has a partition member 9 which is formed of aluminum and is provided at a vertical position between the first heat exchange path P1 and the second heat exchange path P2 so as to divide the space within the header tank 5 into two compartments 5*a* and 5*b* arranged in the vertical direction. A portion of the condenser 1 located on the lower side of the two partition members 8 and 9 is the condensation section 1A, and a portion of the condenser 1 located on the upper side of the two partition members 8 and 9 is the super-cooling section 1B.

The compartment 4*a* of the right header tank 4 located below the partition member 8 serves as a condensation section inlet header section 11 which communicates with upstream (with respect to the refrigerant flow direction) end portions of the heat exchange tubes 3 of the first heat exchange path P1. Similarly, the compartment 4*b* of the right header tank 4 located above the partition member 8 serves as a super-cooling section outlet header section 12 which communicates with downstream (with respect to the refrigerant flow direction) end portions of the heat exchange tubes 3 of the second heat exchange path P2. The compartment 5*a* of the left header tank 5 located below the partition member 9 serves as a condensation section outlet header section 13 which communicates with downstream (with respect to the refrigerant flow direction) end portions of the heat exchange tubes 3 of the first heat exchange path P1. Similarly, the compartment 5*b* of the left header tank 5 located above the partition member 9 serves as a super-cooling section inlet header section 14 which communicates with upstream (with respect to the refrigerant flow direction) end portions of the heat exchange tubes 3 of the second heat exchange path P2.

A refrigerant inlet 15 is formed in the condensation section inlet header section 11 of the right header tank 4 at an intermediate position in the vertical direction, and a refrigerant inlet member 16 formed of aluminum and having a passage communicating with the refrigerant inlet 15 is joined to the right header tank 4. A refrigerant outlet 17 is formed in the super-cooling section outlet header section 12 of the right header tank 4, and a refrigerant outlet member 18 formed of aluminum and having a passage communicating with the refrigerant outlet 17 is joined to the right header tank 4. A header-section-side refrigerant outlet 19 is formed in the condensation section outlet header section 13 of the left header tank 5 at a position near the lower end of the condensation section outlet header section 13. Similarly, a header-section-side refrigerant inlet 21 is formed in a lower portion of the super-cooling section inlet header section 14 of the left header tank 5.

As shown in FIGS. 3 and 4, the liquid receiver 2 includes a liquid receiver main body 22 and a circular columnar plug 25 (closing member). The liquid receiver main body 22 is composed of a cylindrical tubular member 23 formed of aluminum, and a lower-end closing member 24 formed of aluminum and brazed to the lower end of the cylindrical tubular member 23 so as to close an opening of the cylindrical tubular member 23 at the lower end. The liquid receiver main body 22 is brazed to the left header tank 5. The circular columnar plug 25 is formed of synthetic resin and closes an opening of the liquid receiver main body 22 at the upper end. A liquid-receiver-side refrigerant inlet 26 which communicates with the header-section-side refrigerant outlet 19 is formed in the cylindrical tubular member 23 of the liquid receiver main body 22 at a position near the lower end. Similarly, a liquid-receiver-side refrigerant outlet 27 which communicates with the header-section-side refrigerant inlet 21 is formed in the cylindrical tubular member 23 at a vertical position above the partition member 9. An internal thread 23*a* is formed on an upper end portion of the inner circumferential surface of the cylindrical tubular member 23 of the liquid receiver main body 22. An external thread 25*a* formed on an upper portion of the outer circumferential surface of the plug 25 is brought into screw engagement with the internal thread 23*a* of the liquid receiver main body 22, whereby the plug 25 is removably attached to the upper end of the liquid receiver main body 22. Notably, for the purpose of sealing, an O-ring 28 is disposed between a portion of the inner circumferential surface of the cylindrical tubular member 23 of the liquid receiver main body 22, the portion being located below the internal thread 23*a*, and a portion of the outer circumferential surface of the plug 25, the portion being located below the external thread 25*a*.

The liquid receiver 2 includes a partition member 29 (partition portion) which is formed of synthetic resin and which divides the space within the liquid receiver 2 into two compartments 2*a* and 2*b* arranged in the vertical direction. The compartment 2*a* on the lower side serves as a first space 31 which communicates with the condensation section 1A through the liquid-receiver-side refrigerant inlet 26. The compartment 2*b* on the upper side serves as a second space 32 which is located above the first space 31 and which communicates with the super-cooling section 1B through the liquid-receiver-side refrigerant outlet 27. The partition member 29 has an internal volume adjustment portion 33 which increases the internal volume of the first space 31 and decreases the internal volume of the second space 32.

The partition member 29 has a cylindrical tubular portion 34 and a seal portion 35. The cylindrical tubular portion 34 has a circumferential wall 34*a* and a closing wall 34*b* which closes an opening of the circumferential wall 34*a* at the upper end, and is open downward. The seal portion 35 projects radially outward from the lower end of the circumferential wall 34*a* of the cylindrical tubular portion 34. A peripheral edge of the seal portion 35 is in contact with the inner circumferential surface of the cylindrical tubular member 23 of the liquid receiver 2 at a vertical position between the liquid-receiver-side refrigerant inlet 26 and the liquid-receiver-side refrigerant outlet 27. The internal space of the cylindrical tubular portion 34 of the partition member 29 communicates with the first space 31, whereby the internal volume of the first space 31 is increased, and the internal volume of the second space 32 decreased. The cylindrical tubular portion 34 constitutes the internal volume adjustment portion 33. The upper end of the cylindrical tubular portion 34 of the partition member 29 is located at a vertical position above the liquid-receiver-side refrigerant outlet 27. Thus, the internal volume of the second space 32 within the liquid receiver 2 is decreased effectively. A through hole 36 is formed at the center of the closing wall 34*b* of the cylindrical tubular portion 34 of the partition member 29.

A suction pipe 37 having a circular transverse cross section is disposed in the first space 31 within the liquid receiver 2. The suction pipe 37 is open at the upper and lower ends thereof and establishes communication between the second space 32 and a region of the first space 31 located near the lower end thereof. An upper end portion of the suction pipe 37 is integrated with the lower surface of the closing wall 34*b* of the cylindrical tubular portion 34 of the partition member 29 in a region around the through hole 36. Accordingly, the space within the suction pipe 37 communicates with the second space 32 through a communication opening formed by the through hole 36. A filter 38 is provided at the lower end of the suction pipe 37 so as to remove foreign substances from the refrigerant flowing from the first space 31 into the space within the suction pipe 37.

Further, a desiccant accommodation portion 39 having a cylindrical tubular shape is integrally provided. The desiccant accommodation portion 39 extends downward from the lower end of the circumferential wall 34*a* of the cylindrical tubular portion 34 of the partition member 29. A desiccant 41 is disposed in a region extending from the space within the desiccant accommodation portion 39 to the space within the cylindrical tubular portion 34. The lower end of the desiccant accommodation portion 39 is located above the lower end of the suction pipe 37, and a portion of the lower end opening of the desiccant accommodation portion 39 around the suction pipe 37 is closed by a closing member 42 formed of synthetic resin. A plurality of refrigerant passage holes 43 are formed in the circumferential wall 34*a* of the desiccant accommodation portion 39 such that the refrigerant passage holes 43 penetrate the circumferential wall 34*a*.

Further, an operation portion 44 having a cylindrical tubular shape is integrally provided on the upper surface of the closing wall 34*b* of the cylindrical tubular portion 34 of the partition member 29. The operation portion 44 projects upward from the upper surface of the closing wall 34*b* in a region around the through hole 36. The operation portion 44 is open at the upper and lower ends thereof. Therefore, the space within the suction pipe 37 communicates with the second space 32 through the through hole 36 of the closing wall 34*b* of the cylindrical tubular portion 34 and the space within the operation portion 44. The operation portion 44 has through holes 44*a* formed in the circumferential wall thereof at positions at which a diameter line intersects the circumferential wall. The upper end of the operation portion 44 is located in a recess 25*b* formed on the lower surface of the plug 25.

The cylindrical tubular portion 34 and seal portion 35 of the partition member 29, the suction pipe 37, the desiccant accommodation portion 39, and the operation portion 44 are formed integrally through use of synthetic resin.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into the condensation section inlet header section 11 of the right header tank 4 through the refrigerant inlet member 16 and the refrigerant inlet 15. The refrigerant is condensed, while flowing leftward within the heat exchange tubes 3 of the first heat exchange path P1, and flows into the condensation section outlet header section 13 of the left header tank 5. The refrigerant having flowed into the condensation section outlet header section 13 of the left header tank 5 enters the first space 31 within the liquid receiver 2 through the header-section-side refrigerant outlet 19 and the liquid-receiver-side refrigerant inlet 26.

The refrigerant having flowed into the first space 31 within the liquid receiver 2 is in a gas-liquid mixed phase, and liquid phase predominant refrigerant which is a portion of the gas-liquid mixed phase refrigerant accumulates in a lower portion of the internal space of the liquid receiver 2 due to the gravitational force. Also, within the first space 31 of the liquid receiver 2, the refrigerant passes through the refrigerant passage holes 43 and comes into contact with the desiccant 41 within the desiccant accommodation portion 39, whereby the moisture within the refrigerant is removed. The liquid phase predominant refrigerant having accumulated in a lower portion of the internal space of the liquid receiver 2 passes through the filter 38, enters the suction pipe 37, and flows into the second space 32 through the internal space of the suction pipe 37, the through hole 36 of the cylindrical tubular portion 34 of the partition member 29, and the operation portion 44.

The liquid phase predominant refrigerant having flowed into the second space 32 within the liquid receiver 2 enters the super-cooling section inlet header section 14 of the left header tank 5 through the liquid-receiver-side refrigerant outlet 27 and the header-section-side refrigerant inlet 21.

The refrigerant having entered the super-cooling section inlet header section 14 of the left header tank 5 is super-cooled, while flowing rightward within the heat exchange tubes 3 of the second heat exchange path P2. Subsequently, the super-cooled refrigerant enters the super-cooling section outlet header section 12 of the right header tank 4 and flows out through the refrigerant outlet 17 and the refrigerant outlet member 18. The refrigerant is then fed to the evaporator through the expansion valve.

When a car air conditioner including the above-described condenser is charged with refrigerant, the second space 32 of the liquid receiver 2 is filled with liquid-phase refrigerant within a relatively short time, because the first space 31 has an increased internal volume and the second space 32 has a decreased internal volume as a result of the action of the internal volume adjustment portion 33 of the partition member 29. Accordingly, the interiors of the heat exchange tubes 3 of the second heat exchange path P2 which is the refrigerant super-cooling path can be quickly filled with the liquid-phase refrigerant. As a result, the refrigerant charge amount in the refrigeration cycle quickly reaches a proper charge amount for realizing a predetermined degree of super-cooling. In addition, the width of a stable range within which the predetermined degree of super-cooling is attained; i.e., the width of a range of the refrigerant charge amount within which the predetermined degree of super-cooling is attained, increases. Therefore, the super-cooling performance of the condenser becomes more stable against variation of load and leakage of refrigerant.

In the above-described embodiment, for the purpose of sealing, an O-ring may be interposed between the outer circumferential surface of the seal portion 35 of the partition member 29 and the inner circumferential surface of the cylindrical tubular member 23 of the liquid receiver main body 22 of the liquid receiver 2.

Figure 5:
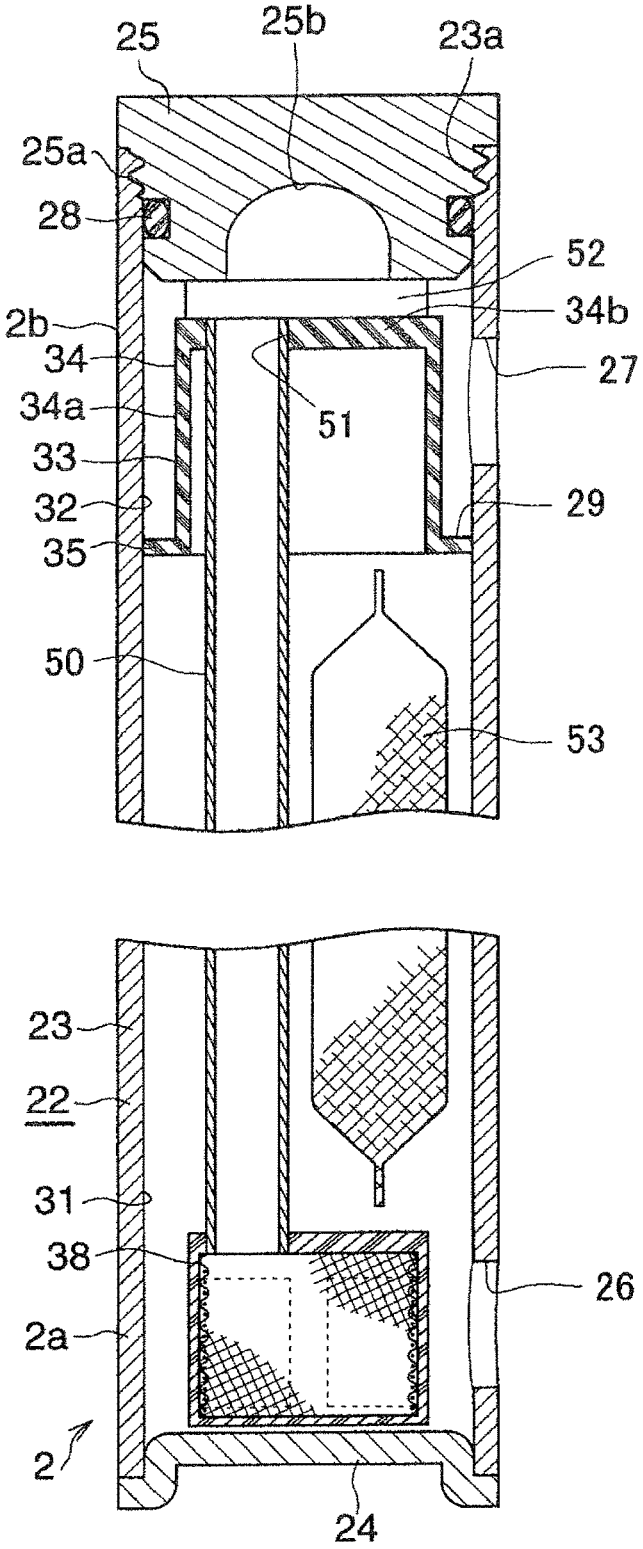
FIG. 5 is a partially-omitted vertical sectional view showing a modification of the internal structure of the liquid receiver of the condenser of FIG. 1.
Figure 6:
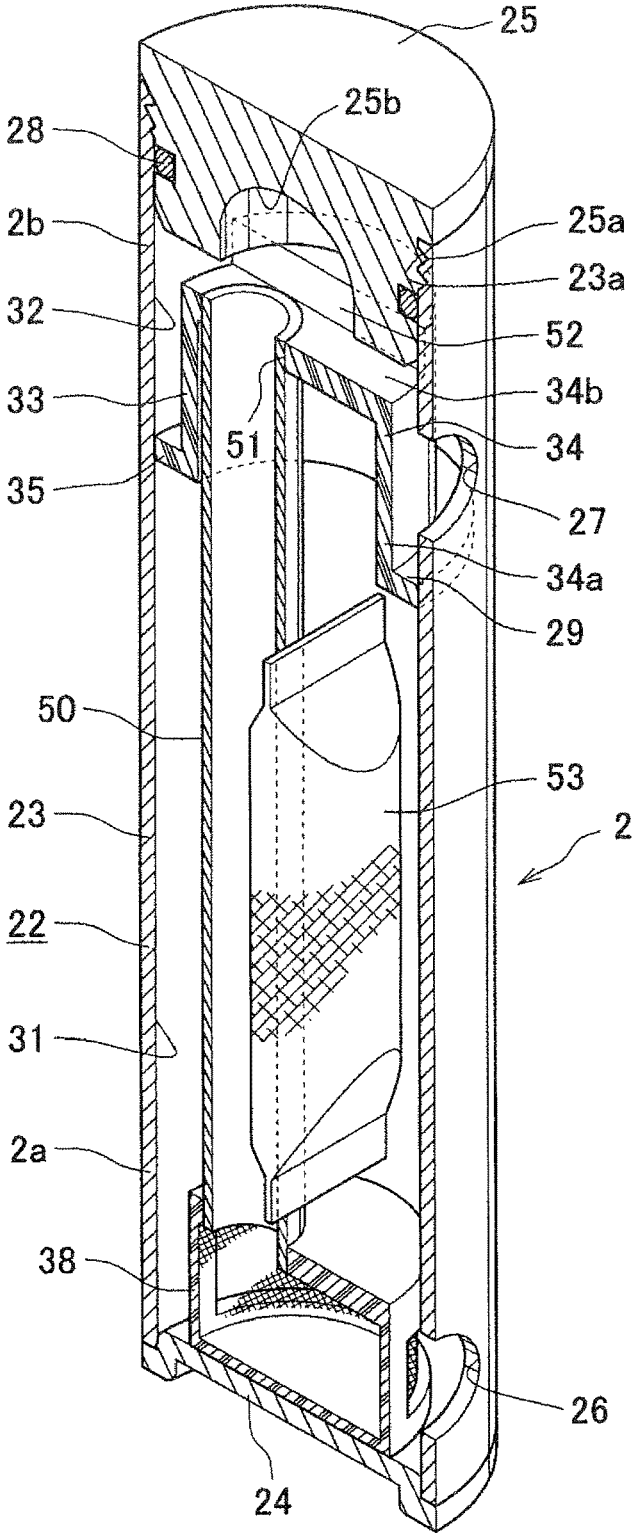
FIG. 6 is a perspective view showing the modification of the internal structure of the liquid receiver of the condenser of FIG. 1 in which a main portion of the liquid receiver is cut away.

FIGS. 5 and 6 show a modification of the internal structure of the liquid receiver 2 used in the condenser 1.

In FIGS. 5 and 6, a suction pipe 50 which has a circular transverse cross section, is open at the upper and lower ends thereof, is disposed in the first space 31 within the liquid receiver 2, and establishes communication between the second space 32 and a region of the first space 31 located near the lower end thereof is formed separately from the cylindrical tubular portion 34 which constitutes the internal volume adjustment portion 33 of the partition member 29. The suction pipe 50 is attached to the closing wall 34*b* of the cylindrical tubular portion 34. Namely, a circular through hole 51 is formed in the closing wall 34*b* of the cylindrical tubular portion 34 at an eccentric position. The suction pipe 50 is attached to the closing wall 34*b* as a result of insertion of an upper end portion of the suction pipe 50 into the through hole 51, and the upper end opening of the suction pipe 50 faces the second space 32. Also, an upper projection portion 52 is integrally formed on the upper surface of the closing wall 34*b* of the cylindrical tubular portion 34 at a position deviated from the through hole 51 such that the upper projection portion 52 projects upward, and its projection end comes into contact with the lower surface of the plug 25, and such that the upper projection portion 52 does not close the entire lower end opening of the recess 25*b*.

A desiccant bag 53 which is gas permeable and liquid permeable, which accommodates a desiccant, and whose longitudinal direction coincides with the vertical direction is accommodated in a portion of the first space 31 of the liquid receiver 2, the portion being located below the seal portion 35 of the partition member 29.

Except the above-described point, the liquid receiver 2 of the modification has the same internal structure as the liquid receiver 2 in the above-described embodiment.

The present invention comprises the following modes.

1) A condenser comprising a condensation section, a super-cooling section provided above the condensation section, and a liquid receiver provided between the condensation section and the super-cooling section, each of the condensation section and the super-cooling section having at least one heat exchange path formed by a plurality of heat exchange tubes disposed parallel to one another such that their longitudinal direction coincides with a left-right direction and they are spaced from one another in a vertical direction, refrigerant flowing out of the condensation section flowing into the super-cooling section through the liquid receiver, wherein the liquid receiver has a refrigerant inlet through which the refrigerant from the condensation section flows into the liquid receiver, and a refrigerant outlet which is located above the refrigerant inlet and through which the refrigerant flows out to the super-cooling section, a partition portion is provided in the liquid receiver so as to divide a space within the liquid receiver into a first space communicating with the condensation section through the refrigerant inlet, and a second space located above the first space and communicating with the super-cooling section through the refrigerant outlet, a suction pipe which is open at upper and lower ends thereof and establishes communication between the first space and the second space is disposed in the first space of the liquid receiver, and a space within the suction pipe communicates with the second space through a communication opening provided in the partition portion, wherein the partition portion has an internal volume adjustment portion for increasing an internal volume of the first space and decreasing an internal volume of the second space.

2) A condenser described in par. 1), wherein the partition portion is composed of a tubular portion which has a circumferential wall and a closing wall for closing an upper end opening of the circumferential wall and which is open downward, and a seal portion which projects outward from the circumferential wall of the tubular portion and whose peripheral edge portion is in contact with an inner circumferential surface of the liquid receiver at a vertical position between the refrigerant inlet and the refrigerant outlet, wherein a space within the tubular portion communicates with the first space, and the tubular portion constitutes the internal volume adjustment portion.

3) A condenser described in par. 2), wherein an upper end of the tubular portion which constitutes the internal volume adjustment portion of the partition portion is located above the refrigerant outlet.

4) A condenser described in par. 2) or 3), wherein the suction pipe is integrally provided on the closing wall of the tubular portion which constitutes the internal volume adjustment portion of the partition portion, and the closing wall has the communication opening which is formed by a through hole and which establishes communication between the space within the suction pipe and the second space.

5) A condenser described in par. 4), wherein a tubular operation portion is provided on the closing wall of the tubular portion which constitutes the internal volume adjustment portion of the partition portion, the tubular operation portion being formed around the through hole such that the tubular operation portion projects upward rom the closing wall and is open at upper and lower ends thereof, and a space inside the tubular operation portion communicates with the through hole and the second space.

6) A condenser described in par. 2) or 3), wherein the suction pipe is formed separately from the tubular portion which constitutes the internal volume adjustment portion of the partition portion, an upper end portion of the suction pipe is inserted into a through hole formed in the closing wall of the tubular portion, and an upper end opening of the suction pipe faces the second space.

7) A condenser described in any of pars. 2) to 6), wherein a tubular desiccant accommodation portion extends downward from a lower end of the circumferential wall of the tubular portion which constitutes the internal volume adjustment portion of the partition portion, and a desiccant is disposed in a region extending from a space within the desiccant accommodation portion to a space within the tubular portion.

8) A condenser described in any of pars. 2) to 6), wherein a desiccant bag which is gas permeable and liquid permeable and which accommodates a desiccant is disposed in the first space of the liquid receiver.

In the condenser of any of pars. 1) to 8), the liquid receiver has a refrigerant inlet through which the refrigerant from the condensation section flows into the liquid receiver, and a refrigerant outlet which is located above the refrigerant inlet and through which the refrigerant flows out to the super-cooling section, a partition portion is provided in the liquid receiver so as to divide a space within the liquid receiver into a first space communicating with the condensation section through the refrigerant inlet, and a second space located above the first space and communicating with the super-cooling section through the refrigerant outlet, a suction pipe which is open at upper and lower ends thereof and establishes communication between the first space and the second space is disposed in the first space of the liquid receiver, and a space within the suction pipe communicates with the second space through a communication opening provided in the partition portion, wherein the partition portion has an internal volume adjustment portion for increasing an internal volume of the first space and decreasing an internal volume of the second space. Therefore, when a refrigeration cycle including the condenser is charged with refrigerant, the second space of the liquid receiver is filled with liquid-phase refrigerant within a relatively short time. Accordingly, at the time of refrigerant charge, the interiors of the heat exchange tubes of the refrigerant super-cooling path can be quickly filled with the liquid-phase refrigerant. As a result, the refrigerant charge amount in the refrigeration cycle quickly reaches a proper charge amount for realizing a predetermined degree of super-cooling.

In addition, since the internal volume of the first space is increased by the internal volume adjustment portion, the width of a stable range within which the predetermined degree of super-cooling is attained; i.e., the width of a range of the refrigerant charge amount within which the predetermined degree of super-cooling is attained, increases. Therefore, the super-cooling performance of the condenser becomes more stable against variation of load and leakage of refrigerant. In general, the capacity of the liquid receiver is determined in order to determine the width of the stable range required for the condenser. In the case where the internal volume adjustment portion for increasing the internal volume of the first space is provided, it is possible to reduce the size and weight of the liquid receiver.

In the condenser of par. 2), the internal volume adjustment portion can be provided on the partition portion by a relatively simple configuration.

In the condenser of par. 3), the effect achieved by the condenser of par. 1) becomes more remarkable.

In the condenser of par. 4), the suction pipe for establishing communication between the first space and the second space can be disposed within the first space of the liquid receiver easily and reliably.

In the condenser of par. 5), when the upper end of the liquid receiver can be opened and closed, placement of the partition portion and the suction pipe into the liquid receiver and removal of the partition portion and the suction pipe from the liquid receiver can be performed easily through use of the operation portion.

In the condenser of par. 6), the suction pipe for establishing communication between the first space and the second space can be disposed within the first space of the liquid receiver easily and reliably.

In the condenser of par. 7), separate preparation of a container for containing the desiccant becomes unnecessary, and the number of parts can be reduced. Also, since the desiccant can be disposed in an upper region within the first space, a lower region within the first space can be utilized efficiently. For example, it is possible to expand the space for disposing a filter and expand the space within the liquid receiver into which the refrigerant from the condensation section first flows, to thereby prevent the hindrance of the flow of the refrigerant by an obstacle. Thus, stable operation of the refrigeration cycle can be maintained.

What is claimed is:

1. A condenser comprising a condensation section, a super-cooling section provided above the condensation section, and a liquid receiver provided between the condensation section and the super-cooling section, each of the condensation section and the super-cooling section having at least one heat exchange path formed by a plurality of heat exchange tubes disposed parallel to one another such that their longitudinal direction coincides with a left-right direction and they are spaced from one another in a vertical direction, refrigerant flowing out of the condensation section flowing into the super-cooling section through the liquid receiver, wherein the liquid receiver has a refrigerant inlet through which the refrigerant from the condensation section flows into the liquid receiver, and a refrigerant outlet which is located above the refrigerant inlet and through which the refrigerant flows out to the super-cooling section, a partition portion is provided in the liquid receiver so as to divide a space within the liquid receiver into a first space communicating with the condensation section through the refrigerant inlet, and a second space located above the first space and communicating with the super-cooling section through the refrigerant outlet, a suction pipe which is open at upper and lower ends thereof and establishes communication between the first space and the second space is disposed in the first space of the liquid receiver, and a space within the suction pipe communicates with the second space through a communication opening provided in the partition portion, wherein the partition portion has an internal volume adjustment portion that provides an increased internal volume of the first space and a correspondingly decreased internal volume of the second space, wherein the partition portion is composed of a tubular portion which has a circumferential wall and a closing wall for closing an upper end opening of the circumferential wall and which is open downward, and a seal portion which projects outward from the circumferential wall of the tubular portion and whose peripheral edge portion is in contact with an inner circumferential surface of the liquid receiver at a vertical position between the refrigerant inlet and the refrigerant outlet, wherein a space within the tubular portion communicates with the first space, and the tubular portion constitutes the internal volume adjustment portion.

2. The condenser according to claim 1, wherein an upper end of the tubular portion which constitutes the internal volume adjustment portion of the partition portion is located above the refrigerant outlet.

3. The condenser according to claim 1, wherein the suction pipe is integrally provided on the closing wall of the tubular portion which constitutes the internal volume adjustment portion of the partition portion, and the closing wall has the communication opening which is formed by a through hole and which establishes communication between the space within the suction pipe and the second space.

4. The condenser according to claim 3, wherein a tubular operation portion is provided on the closing wall of the tubular portion which constitutes the internal volume adjustment portion of the partition portion, the tubular operation portion being formed around the through hole such that the tubular operation portion projects upward from the closing wall and is open at upper and lower ends thereof, and a space inside the tubular operation portion communicates with the through hole and the second space.

5. The condenser according to claim 2, wherein the suction pipe is integrally provided on the closing wall of the tubular portion which constitutes the internal volume adjustment portion of the partition portion, and the closing wall has the communication opening which is formed by a through hole and which establishes communication between the space within the suction pipe and the second space.

6. The condenser according to claim 5, wherein a tubular operation portion is provided on the closing wall of the tubular portion which constitutes the internal volume adjustment portion of the partition portion, the tubular operation portion being formed around the through hole such that the tubular operation portion projects upward from the closing wall and is open at upper and lower ends thereof, and a space inside the tubular operation portion communicates with the through hole and the second space.

7. The condenser according to claim 1, wherein the suction pipe is formed separately from the tubular portion which constitutes the internal volume adjustment portion of the partition portion, an upper end portion of the suction pipe is inserted into a through hole formed in the closing wall of the tubular portion, and an upper end opening of the suction pipe faces the second space.

8. The condenser according to claim 2, wherein the suction pipe is formed separately from the tubular portion which constitutes the internal volume adjustment portion of the partition portion, an upper end portion of the suction pipe is inserted into a through hole formed in the closing wall of the tubular portion, and an upper end opening of the suction pipe faces the second space.

9. The condenser according to claim 1, wherein a tubular desiccant accommodation portion extends downward from a lower end of the circumferential wall of the tubular portion which constitutes the internal volume adjustment portion of the partition portion, and a desiccant is disposed in a region extending from a space within the desiccant accommodation portion to a space within the tubular portion.

10. The condenser according to claim 1, wherein a desiccant bag which is gas permeable and liquid permeable and which accommodates a desiccant is disposed in the first space of the liquid receiver.

* * * * *